United States Patent [19]

Kelly et al.

[11] 4,344,738

[45] Aug. 17, 1982

[54] ROTOR DISK STRUCTURE

[75] Inventors: Wallace N. Kelly, Bolton; Roger D. Breunig, Meriden, both of Conn.

[73] Assignee: United Technologies Corporation, Hartford, Conn.

[21] Appl. No.: 103,980

[22] Filed: Dec. 17, 1979

[51] Int. Cl.[3] ..... F01D 5/08

[52] U.S. Cl. ..... 416/95

[58] Field of Search ..... 416/95, 92, 96, 97

[56] References Cited

U.S. PATENT DOCUMENTS 3,527,543 9/1970 Howald .
3,836,279 9/1974 Lee .
3,918,835 11/1975 Yamarik et al. ..... 416/97 R
3,982,852 9/1976 Andersen et al. ..... 416/95
4,008,980 2/1977 Noehren et al. .
4,203,705 5/1980 Wesbecher ..... 416/95

*Primary Examiner*—Robert E. Garrett
*Attorney, Agent, or Firm*—Gene D. Fleischhauer

[57] ABSTRACT

A rotor disk adapted to receive a plurality of coolable rotor blades of a gas turbine engine is disclosed. Various construction details for cooling air holes in rotor disks are developed. In structures embodying the present invention tangential stress concentration factors are reduced. The elongated axis of each cooling air hole lies in a plane perpendicular to the axis of symmetry of the disk.

6 Claims, 3 Drawing Figures

ROTOR DISK STRUCTURE

BACKGROUND OF THE INVENTION

1. Field of the Invention

This invention relates to axial flow rotary machines and, more specifically to the reduction of maximum stress concentrations in a rotor disk for such a rotor machine.

2. Description of the Prior Art

A gas turbine engine has a compression section, a combustion section and a turbine section. An annular flowpath for working medium gases extends axially through the engine. The turbine section of the engine has a rotor assembly and a stator assembly. The annular flowpath passes in alternating succession between components of the stator assembly and components of the rotor assembly. The rotor assembly includes a disk having an axis of symmetry and a plurality of rotor blades extending outwardly into the hot working medium gases. The rotor blades are in intimate contact with the hot working medium gases and are heated by these hot gases.

In modern engines, cooling air is flowed through passages on the interior of the turbine blade to remove heat from the rotor blades. Typically, the cooling air is supplied through the disk by cooling air holes. One representative cooling air hole construction is shown in U.S. Pat. No. 3,836,279 issued to Lee entitled, "Seal Means for Blade and Shroud." The disk is adapted by a blade attachment slot to receive the rotor blades. Each cooling air hole has an exit opening in the bottom of the corresponding slot. The cross section of the disk changes abruptly at the slot location. As the disk rotates in a plane perpendicular to the axis of symmetry, the rotational forces induce tangential stress in the disk material. The interruption of the uniformity of the cross-sectional area results in a large concentration of stress at the cooling air holes. This condition is particularly serious in areas of repeated loads because the material will experience fatigue failure if the maximum stress is greater than the fatigue strength associated with an acceptable low cycle fatigue life.

At present the tangential stress concentrations at the cooling air passage in the rim of the disk cause that location to be the limiting low cycle fatigue life location of the disk. Accordingly scientists and engineers are working to provide a passage for cooling air having reduced tangential stress concentrations such that the disk has an improved low cycle fatigue life.

SUMMARY OF THE INVENTION

A primary object of the present invention is to provide a passage for cooling air through a rotor disk. Improved low cycle fatigue life is sought and a specific object is to reduce the concentrations of tangential stresses at the cooling air passage in the rim of the disk.

According to the present invention, the concentration of tangential stresses at cooling air holes in a rotor disk is reduced by providing a hole having a cross-section geometry which is elongated about a major axis lying in a plane perpendicular to the axis of symmetry of the rotor disk.

A primary feature of the present invention is an elongated cooling hole extending radially outwardly through the rim of the disk. The hole has a minor axis and a major axis. The major axis lies in a plane perpendicular to the axis of symmetry of the disk and parallel to the direction of rotation. In one embodiment, the perimeter of the hole is symmetrical about the major axis and is symmetrical about the minor axis. Another feature is the extent of the elongation of the hole.

A principal advantage of the present invention is the good low cycle fatigue life which results from the reduced magnitude of the concentrated tangential stresses at each cooling air hole as compared with cooling air holes of circular cross section. The magnitude of the stresses results from the narrow profile which the elongated hole presents to the tangential stress field resulting from the lines of tangential force flow.

The foregoing and other objects, features and advantages of the present invention will become more apparent in the light of the following detailed description of preferred embodiments thereof as discussed and illustrated in the accompanying drawing.

DETAILED DESCRIPTION

Figure 1:
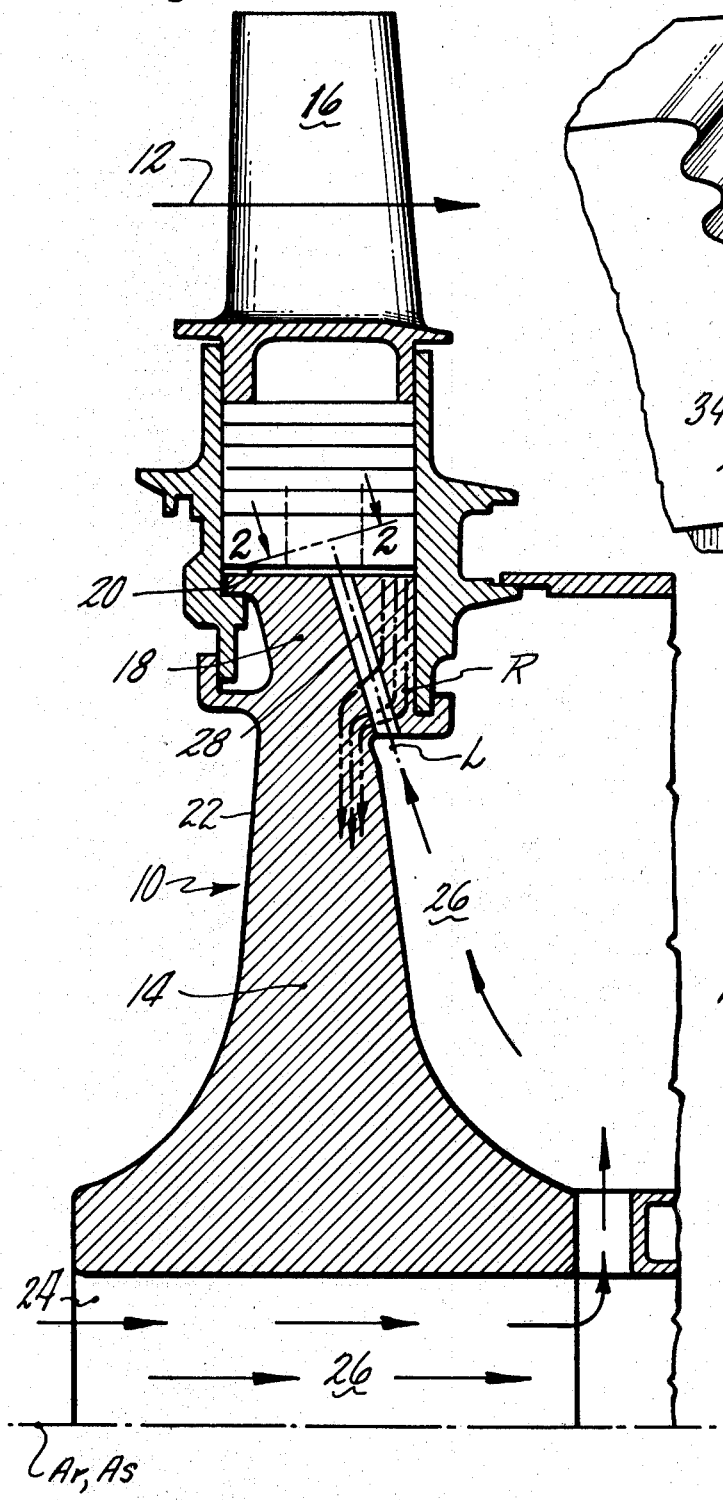
FIG. 1 is a simplified cross-section view of a portion of a rotor assembly for a gas turbine engine.

A portion of a rotor assembly 10 of a gas turbine engine is shown in FIG. 1. The rotor assembly has an axis of rotation $A_r$. A flowpath 12 for working medium gases extends through the rotor assembly. The rotor assembly includes a disk 14 and a plurality of coolable rotor blades, as represented by the single rotor blade 16. The rotor blades extend outwardly into the working medium flowpath from the disk. The disk has a rim section 18 which is adapted to receive the rotor blades by slot means, such as a plurality of slots as represented by the single slot 20. The slots extend in a generally axial direction. Those skilled in the art will realize that a single slot extending circumferentially may be used to receive the rotor blades instead of the plurality of slots extending axially.

In addition to the rim section 18, the disk 14 has a web section 22 and a bore section 24. The rim section, the web section, and the bore section extend circumferentially about an axis of symmetry $A_s$. A flowpath 26 for cooling air extends through the bore section and is in gas communication with the disk. A plurality of cooling air holes, as represented by the single cooling air hole 28, extend outwardly through the disk. Each cooling air hole is in gas communication with the cooling air flowpath, a corresponding slot and the coolable rotor blade engaging the slot.

Each cooling air hole 28 has a longitudinal axis L. The longitudinal axis L lies in a radial plane containing the axis of symmetry $A_s$ and the axis of rotation $A_r$. The longitudinal axis L is angled with respect to a plane perpendicular to the axis $A_s$. As those of ordinary skill in the art will realize, the longitudinal axis L may in some cases lie in other planes, such as a plane perpendicular to the axis $A_s$ or in a plane that does not contain the axis $A_s$.

Figure 2:
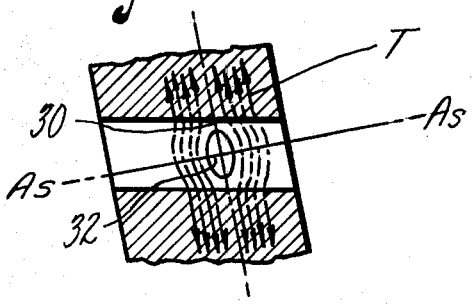
FIG. 2 is a directional view taken along the line 2—2 as shown in FIG. 1.

FIG. 2 is a sectional view taken perpendicular to the longitudinal axis of the cooling air hole 28. The cooling air hole is elongated. The cooling air hole has a major axis 30 and a minor axis 32 at any section perpendicular to the longitudinal axis of the hole. The major axis of the hole lies in a plane perpendicular to the axis of symmetry $A_s$ of the disk. The minor axis of the hole lies in a plane containing the axis of symmetry $A_s$. Preferably the ratio of the length of the major axis to the length of the minor axis lies in the range of one and three-tenths (1.3) to two (2.0).

Figure 3:
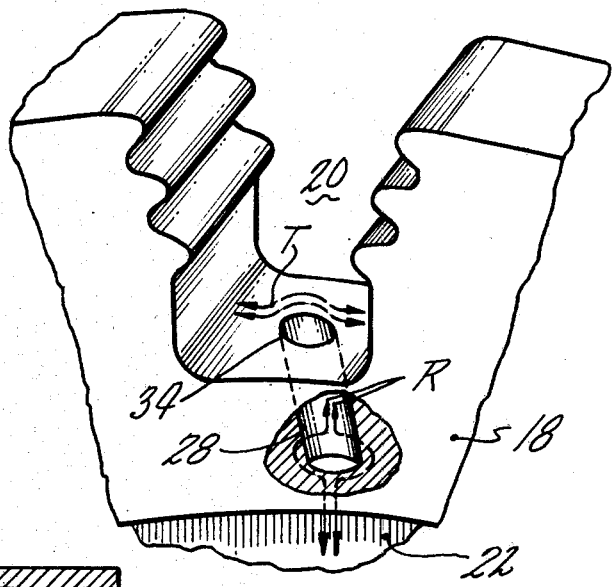
FIG. 3 is a perspective view of the rotor assembly with a portion of the disk broken away to reveal an elongated cooling air hole.

FIG. 3 is a partial perspective view showing the slot 20 and the cooling air hole 28. The cooling air hole has a breakout point 34. Lines T of tangential force flow are shown in the region closely about the breakout point. The disk is broken away below the rim section 18 near the web section 22 to show lines R of radial force flow in the region about the cooling air hole.

During operation of the gas turbine engine, hot working medium gases and cooling air are flowed into the portion of the engine containing the rotor assembly 10. The hot working medium gases pass between the coolable rotor blade 16 extending outwardly from the disk 14 into the flowpath 12 for the hot gases. Cooling air is flowed to the rotor blades through the cooling air holes 28 in the disk.

As the rotor assembly rotates about its axis of rotation $A_r$, radial and tangential forces are generated in the disk. The tangential forces acting in the rim of the disk cause stress concentrations at locations in the rim where the cross-sectional area is non-uniform. The magnitude of the stresses resulting from these forces and from the thermal stresses caused by unequal temperature changes in the disk determines the low cycle fatigue life of the disk. The location in the rim of the disk which has the limiting low cycle fatigue life is the region about the breakout point 34 of the cooling air hole 28.

The cooling air hole 28 through the rim section 18, with the major axis 30 of the cooling air hole lying in a plane perpendicular to the axis of symmetry, presents a narrower profile to the lines T of tangential force flow than do cooling air holes of equal cross-sectional area having a major axis lying in a plane containing the axis of symmetry $A_s$. The narrowest profile is presented to the lines T of tangential force flow by holes having the major axis in a plane perpendicular to the axis of symmetry $A_s$ and the minor axis 32 lying in a plane containing the axis of symmetry $A_s$. Presenting a narrower profile to the lines T of tangential force flow reduces the non-uniformity of the cross-sectional area at that location. Accordingly the stress concentration factor is reduced and the low cycle fatigue life of the disk is increased.

Lines of radial force flow extend inwardly in the rim region as shown in FIG. 1 and FIG. 3. Low cycle fatigue life is sacrificed near the interior of the disk to the benefit of the low cycle fatigue life of the rim. As shown in FIG. 3 in the interior of the disk near the web section, the cooling air hole 28 presents the major axis of the hole to the radial lines of force flow rather than the minor axis of the hole. The cross-sectional discontinuity is larger than if the minor axis were presented to the lines of radial force flow and accordingly this large non-uniformity in cross-sectional area causes increased stress concentrations near the web of the disk. Despite the increase in stress concentrations near the web of the disk, there is no decrease in the low cycle fatigue life for the disk because the stress concentrations caused by the lines of tangential force flow at the rim of the disk in the region of the breakout point 34 of the cooling air hole and the slot cause the limiting low cycle fatigue life location to occur in the rim of the disk.

The major axis 30 of the hole is limited in length by the circumferential width of the narrowest portion of the slot 20. In most cases, the width of the hole will extend over the width of the slot. The minimum length of the minor axis 32 is set by the need for a sufficient hole area to carry the needed cooling air and the stress concentration caused by presenting the major axis to the lines of radial force flow. The maximum length of the minor axis is set by the stress concentration caused by presenting the minor axis to the lines of tangential force flow. For most turbine disks, a ratio of the length of the major axis to the minor axis in the range of 1.3 to 2.0 is thought to be an effective compromise in balancing the tangential stress concentration factors against the radial stress concentration factors. In the design illustrated, the elongated hole is elliptical in shape although holes symmetrical about a single axis, such as the major axis, may also provide effective embodiments.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. For a gas turbine engine, a rotor disk having an axis of symmetry and slot means which adapts the disk to receive a plurality of coolable rotor blades comprising:

a rim section having an elongated hole extending outwardly about a longitudinal axis through the rim section which is in gas communication with the slot and which has a plurality of hole sections perpendicular to the longitudinal axis, each hole section having an elliptical shape and having a major axis and a minor axis;

wherein the major axis of each section lies in a plane perpendicular to the axis of symmetry, and the minor axis of each section lies in a plane parallel to the axis of symmetry.

2. For a gas turbine engine, a rotor disk having an axis of symmetry and slot means which adapts the disk to receive a plurality of coolable rotor blades comprising:

a rim section having an elongated hole extending outwardly about a longitudinal axis through the rim section which is in gas communication with the slot and which has a plurality of hole sections perpendicular to the longitudinal axis, each hole section having a major axis and a minor axis; wherein the major axis of each section lies in a plane perpendicular to the axis of symmetry and wherein the ratio of the major axis to the minor axis lies in the range of one and three-tenths (1.3) to two (2.0).

3. The invention as claimed in claim 1 or 2 wherein the longitudinal axis of the hole lies in a plane containing the axis of symmetry.

4. The invention as claimed in claim 1 or 2 wherein the longitudinal axis of the hole lies in a plane perpendicular to the axis of symmetry.

5. The invention as claimed in claim 2 wherein the minor axis of each hole section lies in a plane containing the axis of symmetry.

6. The invention as claimed in claim 2 wherein the longitudinal axis of the hole lies in a plane containing the axis of symmetry and wherein the longitudinal axis of the hole lies in a plane perpendicular to the axis of symmetry.

* * * * *